US007441301B2

(12) United States Patent
Kresse et al.

(10) Patent No.: US 7,441,301 B2
(45) Date of Patent: Oct. 28, 2008

(54) MOPPING DEVICE FOR MOPPING SURFACES TO BE CLEANED

(75) Inventors: Franz Kresse, Hilden (DE); Heiko Faubel, Wermelskirchen (DE)

(73) Assignee: Ecolab Inc., St. Paul, MN (US)

( * ) Notice: Subject to any disclaimer, the term of this patent is extended or adjusted under 35 U.S.C. 154(b) by 857 days.

(21) Appl. No.: 10/500,782

(22) PCT Filed: Dec. 20, 2002

(86) PCT No.: PCT/EP02/14622

§ 371 (c)(1),
(2), (4) Date: Aug. 16, 2004

(87) PCT Pub. No.: WO03/055372

PCT Pub. Date: Jul. 10, 2003

(65) Prior Publication Data

US 2006/0245820 A1 Nov. 2, 2006

(30) Foreign Application Priority Data

Jan. 3, 2002 (DE) ..... 102 00 033

(51) Int. Cl.
*A47L 13/22* (2006.01)

(52) U.S. Cl. ..... 15/228

(58) Field of Classification Search ..... 15/228, 15/229.6, 229.7

See application file for complete search history.

(56) References Cited

U.S. PATENT DOCUMENTS

| | | | | |
|---|---|---|---|---|
| 1,485,891 | A | | 3/1924 | Sibley |
| 1,899,392 | A | | 2/1933 | Larkin |
| 2,261,411 | A | | 11/1941 | Rees |
| 2,280,556 | A | | 4/1942 | Stromgren |
| 2,824,324 | A | | 2/1958 | Ballbach |
| 3,111,700 | A | | 11/1963 | O'Brien et al. |
| 4,031,673 | A | | 6/1977 | Hagelberg |
| 4,971,471 | A | * | 11/1990 | Sloan ..... 401/203 |

FOREIGN PATENT DOCUMENTS

| | | |
|---|---|---|
| DE | 437256 | 11/1926 |
| DE | 2914230 A1 | 10/1980 |
| DE | 4434496 A1 | 3/1996 |
| DE | 20111178 U | 9/2001 |
| DE | 10142084 C | 7/2003 |
| EP | 0629374 A | 12/1994 |
| JP | 11 197081 | 10/1999 |
| WO | WO 94/15520 A | 7/1994 |

* cited by examiner

*Primary Examiner*—David B Thomas
(74) *Attorney, Agent, or Firm*—Andrew D. Sorensen; Anneliese S. Mayer

(57) ABSTRACT

The invention relates to a mopping device for mopping surfaces to be cleaned. The mopping device is characterized in that the mop covering holder (1) has a reservoir (6) for holding a large quantity of cleaning liquid which can flow via at least one discharge opening (7) inside the mop covering holder (1) to the mop covering (5) attached to the mop covering holder (1). In addition, the mop covering holder (1) has at least one ventilation opening (8), via which air can escape from the reservoir (6) when filling the reservoir (6) with cleaning liquid, and air can flow into the reservoir (6) when cleaning liquid is discharged from said reservoir (6). The mop covering holder (1) itself serves as a conveying element to the cleaning liquid.

20 Claims, 7 Drawing Sheets

Figure 1:
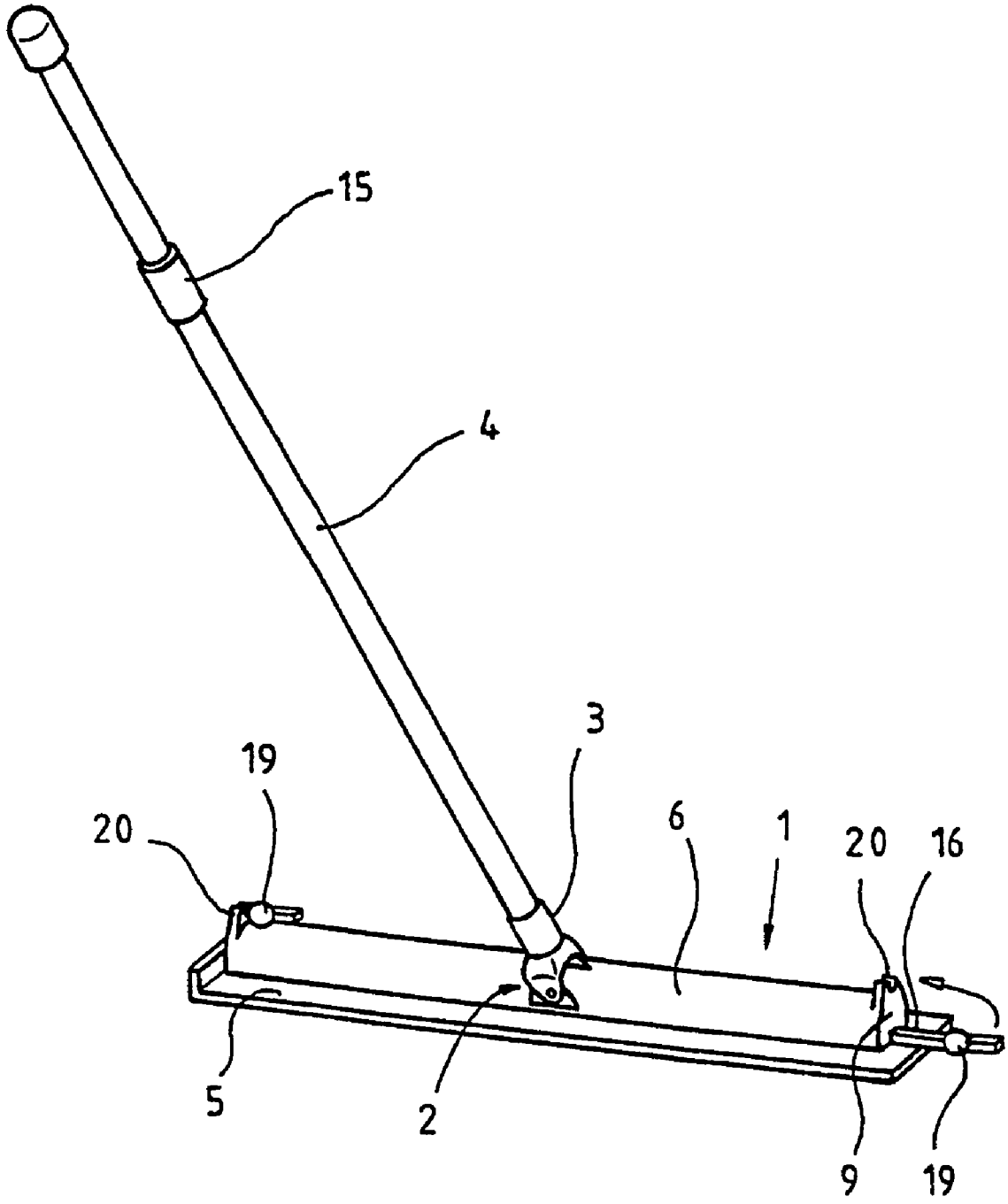

13
4
3
12
11
10
2
20
1
12'
9
6
8
7
17
18

20
19
8
9
6
17
5
16

MOPPING DEVICE FOR MOPPING SURFACES TO BE CLEANED

The invention relates to a mopping device for mopping surfaces to be cleaned, particularly floor surfaces, with the features of the introductory part of claim 1. Parts of the mopping device significant in terms of invention are also the mop covering holder with operating handle as well as the replaceable mop covering.

Mopping devices of the kind in question have been known for decades. They are extensively used in the professional region. Mopping devices of the kind in question therefore have to be very convenient and simple to handle. Since the margins of businesses in the professional field are small, every saving in cost is welcomed.

The subject of the present invention is a mopping device which serves for, in particular, moist-cleaning of surfaces which are to be cleaned. Such surfaces are particularly expensive to clean when a high degree of disinfection has to be achieved, for example in patient rooms of hospitals.

In the past, operation has been with so-called mops which have long, depending tassels, of textile material for transferring the cleaning liquid to the floor. Mopping devices of the kind in question, which have similarly been known for decades and are termed flat mopping devices, have already brought a substantial improvement.

The known mopping device which is constructed as a flat mopping device and from which the invention proceeds (DE 29 14 230 A1) has firstly a mop covering holder at which a handle sleeve, into which an operating handle of greater or lesser length can be inserted, is pivotably mounted usually by way of a universal joint, but occasionally also by way of a simple pivot joint. The mop covering holder is itself constructed as a longitudinally extended rectangular plate or as a longitudinally extended rectangular wire frame.

There are known not only mop covering holders with fixed holders or with fixed wire frames, but also holders with centrally foldable plates or approximately centrally foldable wire frames and corresponding actuating devices. The latter allow a simpler mounting of the flat mop covering (DE 29 14 230 A1).

A mop covering, which is matched to the mop covering holder and consists of textile or textile-like material and which is termed a flat mop covering, is attached to the mop covering holder. This attachment is detachable, because the mop covering has to be pressed out in the meantime and washed from time to time.

The cleaning quality of surfaces which are to be cleaned is basically dependent on the residual moisture. In practice it has proved that a quantity of approximately 11.0 g of cleaning liquid per $m^2$ of a synthetic material floor covering is advantageous. In the case of this degree of moisture the pigment protection is no longer movable, but strongly adheres to the side, which is active in cleaning, of the mop covering. The moist mop covering delivers cleaning liquid during mopping over the floor coverings and takes up dirt particles in a counter action.

The moisture delivery from the mop covering to the surface to be cleaned is not readily controllable. In practice, a wet track of the cleaning liquid is applied centrally to the portion of surface, which is to be cleaned, by the still very wet mop covering and thereafter this excess is distributed on the surface portion, which is to be cleaned, by a swivelling mopping process.

In order to be able to transfer a sufficient quantity of the cleaning liquid from the storage bucket to the surface to be cleaned, the mop covering has to have a certain capability of absorption and capability of retention of cleaning liquid. In practice, mop coverings for flat mopping devices of the state of the art with an area of approximately 400 mm×100 mm have a weight of approximately 180 g. Notwithstanding this relatively high weight, a typical flat mop covering is hardly in a position of absorbing more than about 50 ml of cleaning liquid insofar as it has previously been freed of water only by pressing. Spun-dried flat mop coverings are, thereagainst, in a position of absorbing about 150 mm of cleaning liquid.

In hospitals and in other regions in which it is important to avoid any contamination, operation is with two spun-dried flat mop coverings. The disinfecting solution serving as cleaning liquid is washed in by the first mop covering and subsequently dried by a second spun-dried mop covering. This method is costly, because two mopping processes are required and as a consequence double the number of mop coverings to be washed results.

In order to increase the capability of absorption of cleaning liquid in both directions, thus not only in the application of cleaning liquid to the surface to be cleaned, but also in the drying away of cleaning liquid from the surface to be cleaned, it has already been proposed in practice to construct the mop covering to be multi-layered and provide it with a form of storage surface. The mop covering is thereby even more complex in construction and naturally substantially more expensive to manufacture. Moreover, the effect in practice is still small.

The teaching is based on the problem of so refining and developing the known mopping device explained above that it is more effectively usable in practice. A mop covering holder and the correspondingly associated mop covering shall also be correspondingly designed.

The mopping device according to the invention solves the above-indicated problem by the features of the characterising part of claim 1.

According to the invention a storage container for cleaning liquid is integrated in the mop covering holder. In practice, experiments have already been made with a plastic bottle with cleaning liquid, which has been clipped to the operating handle. These experiments have not, however, led to success.

According to the invention the container for cleaning liquid is integrated in the mop covering holder itself. The cleaning liquid can, on dipping the mop covering holder together with mop covering into the storage bucket with cleaning liquid, enter by itself into the reservoir and after closure of the ventilation opening be retained therein until the mop covering has been placed on the portion of surface to be cleaned. If the moistening decreases during mopping of the surface to be cleaned, the ventilation opening can be opened in the meantime so that cleaning liquid can run back onto the mop covering and the surface to be cleaned. There can be thus achieved, by contrast to the past, a quite precise control of the degree of moistening of the surface to be cleaned.

According to the invention the mop covering holder with the reservoir disposed therein thus takes over the conveying of the cleaning liquid to the work location. The mop covering itself remains responsible only for the distribution of the cleaning liquid on the portion of surface to be cleaned and for the pick-up of dirt.

Quite significant advantages are achieved with such a mopping device in accordance with the invention. Due to the fact that the cleaning liquid is conveyed by means of the mop covering holder itself, the mop covering can be freed of design features which have hitherto determined the absorption capability for cleaning liquid. Larger loops, fringes, tassels, etc., can largely be dispensed with. The weight of the dry mop covering is reduced, for the same size, from about 180 g to about 50 g. A substantial saving of material is thereby given. The washing costs for soiled mop coverings are substantially lower.

The use of cleaning liquid on the surface to be cleaned is controllable more economically than before.

Preferred refinements and developments of the mopping device according to the invention are the subject of further subclaims. A correspondingly designed mop covering holder and a correspondingly designed mop covering are, in themselves, also subject of the invention.

Figures 2A, 2B:
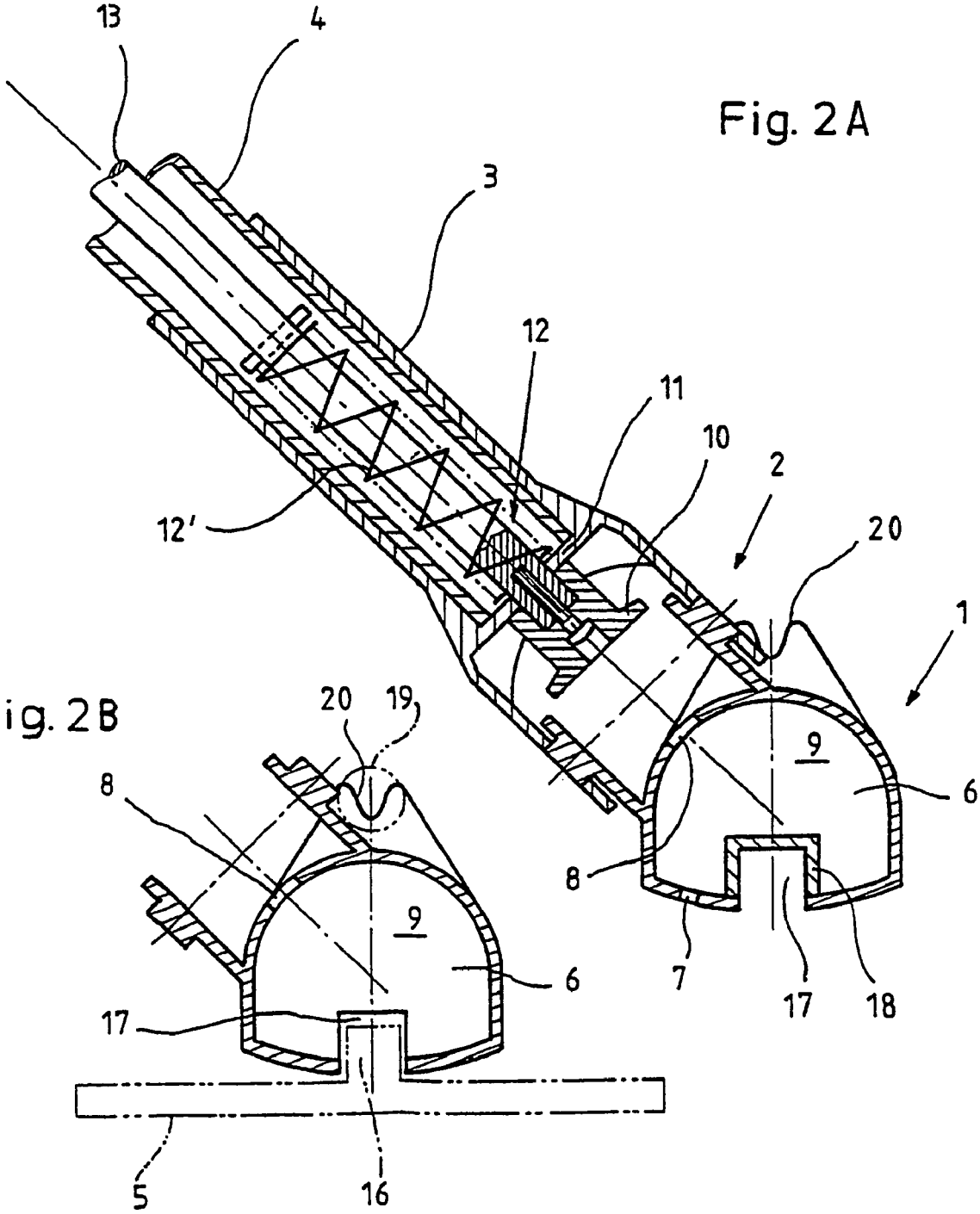
Figure 3:
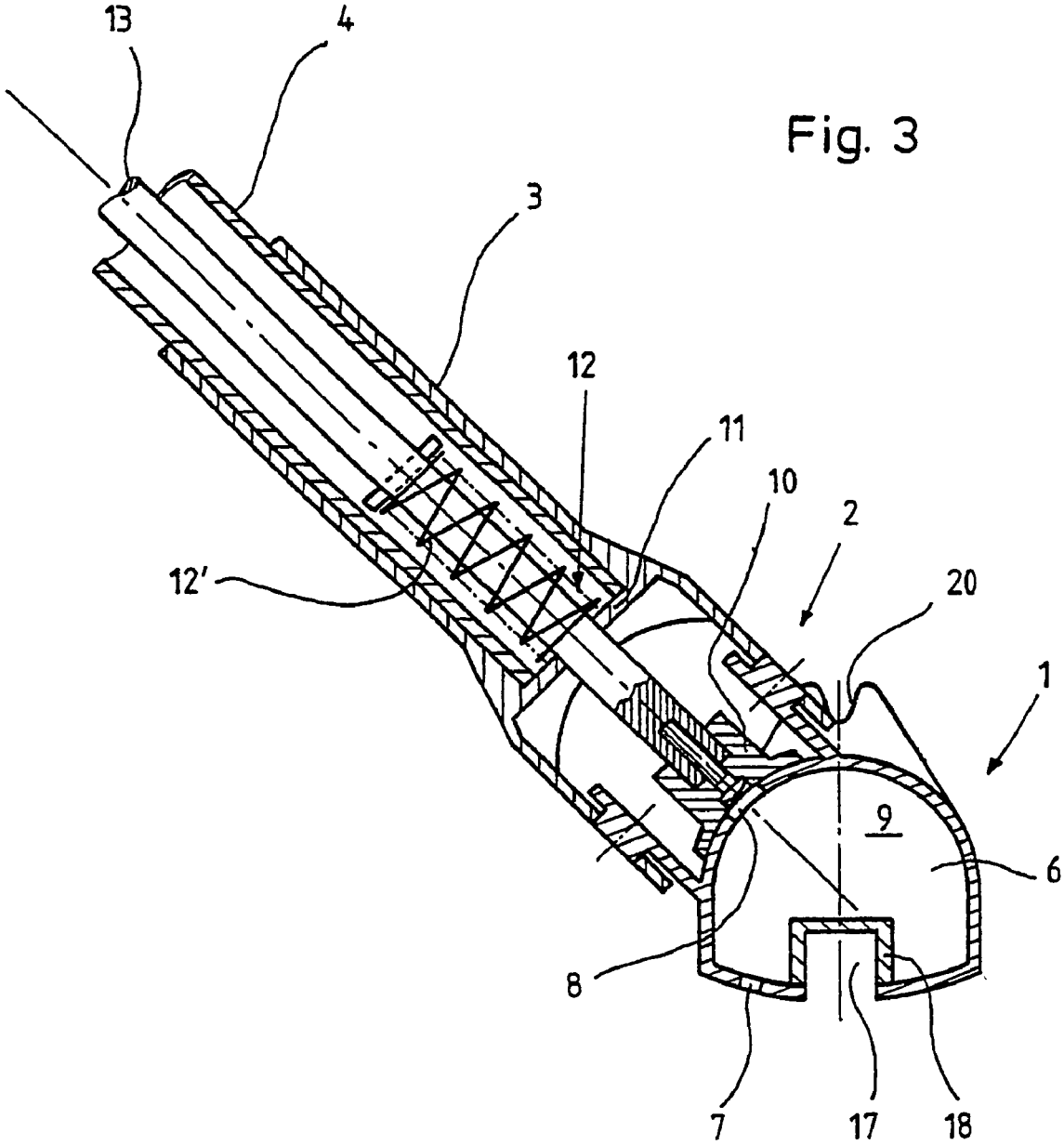
Figure 4:
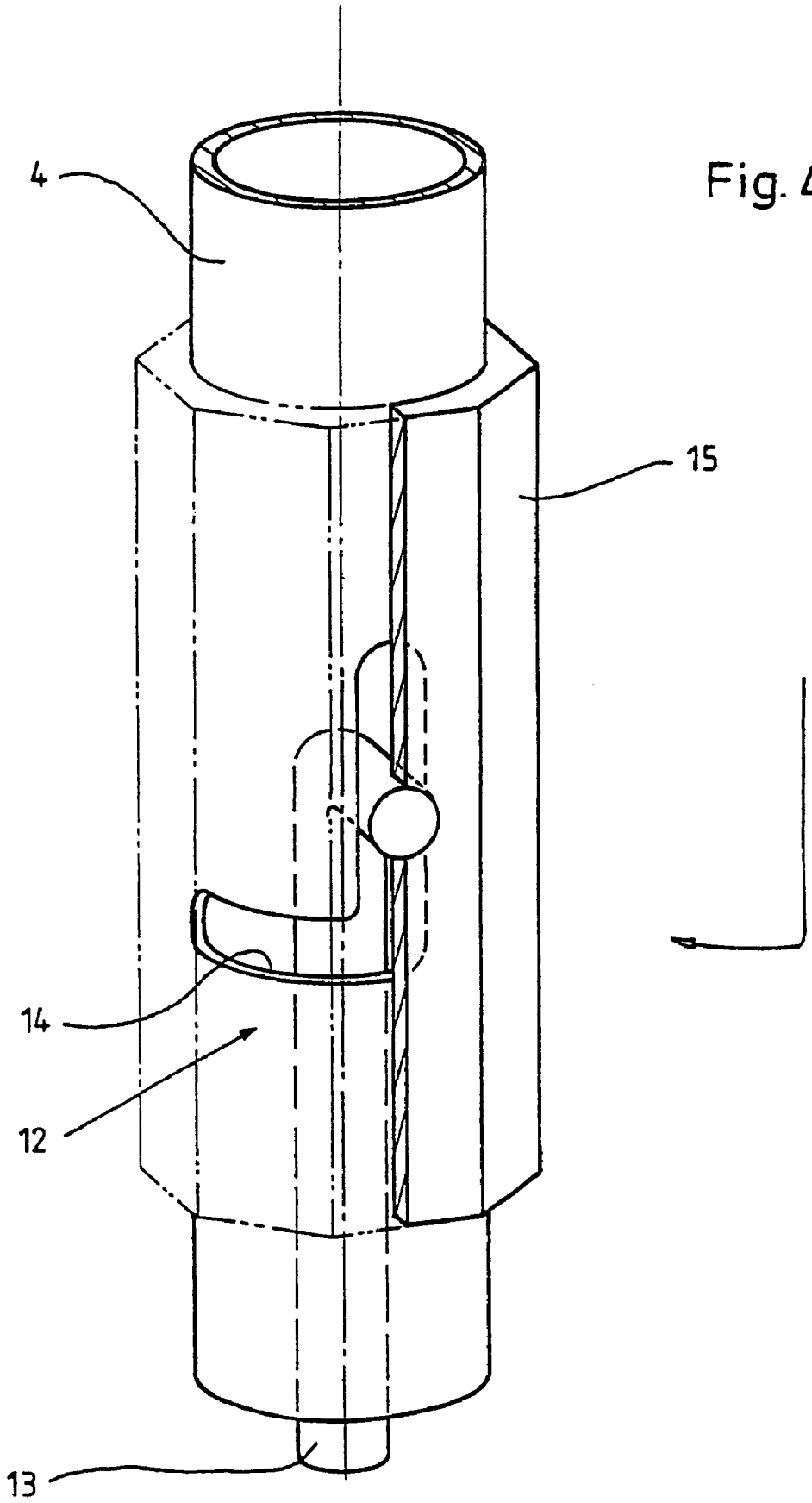
Figure 5:
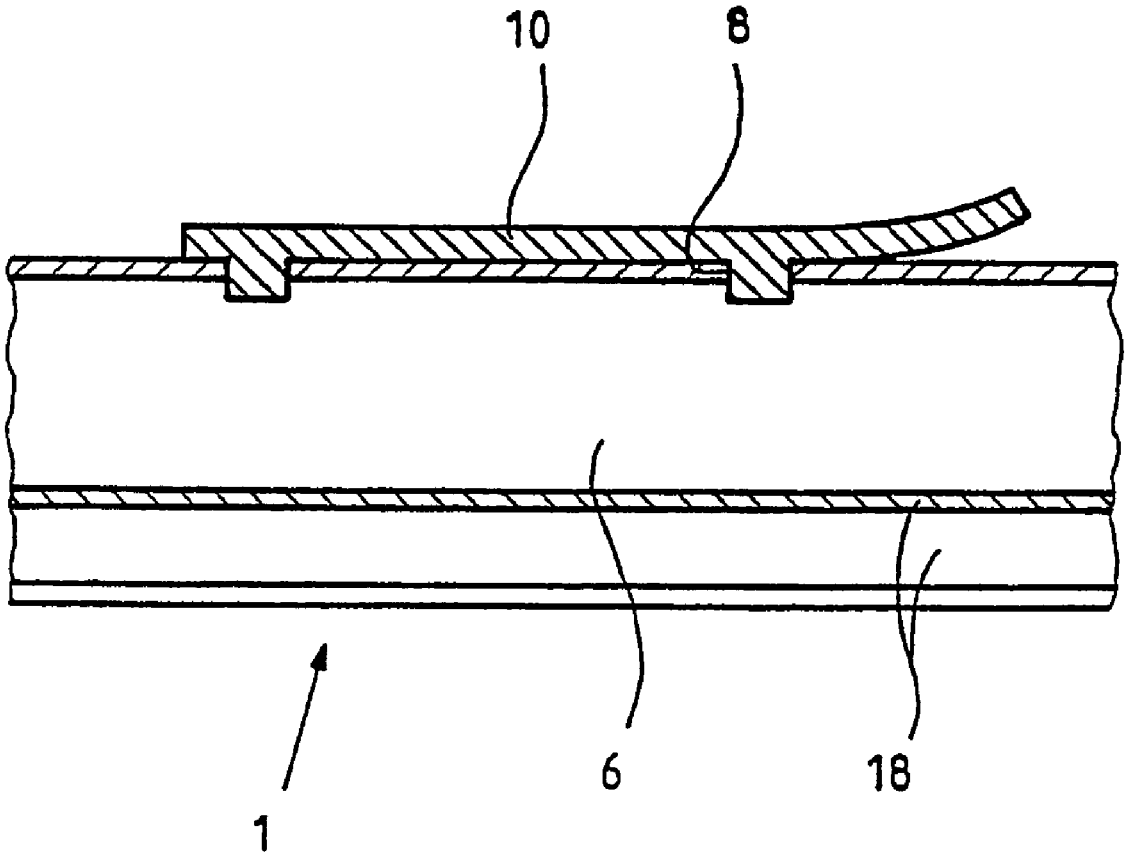
Figure 6:
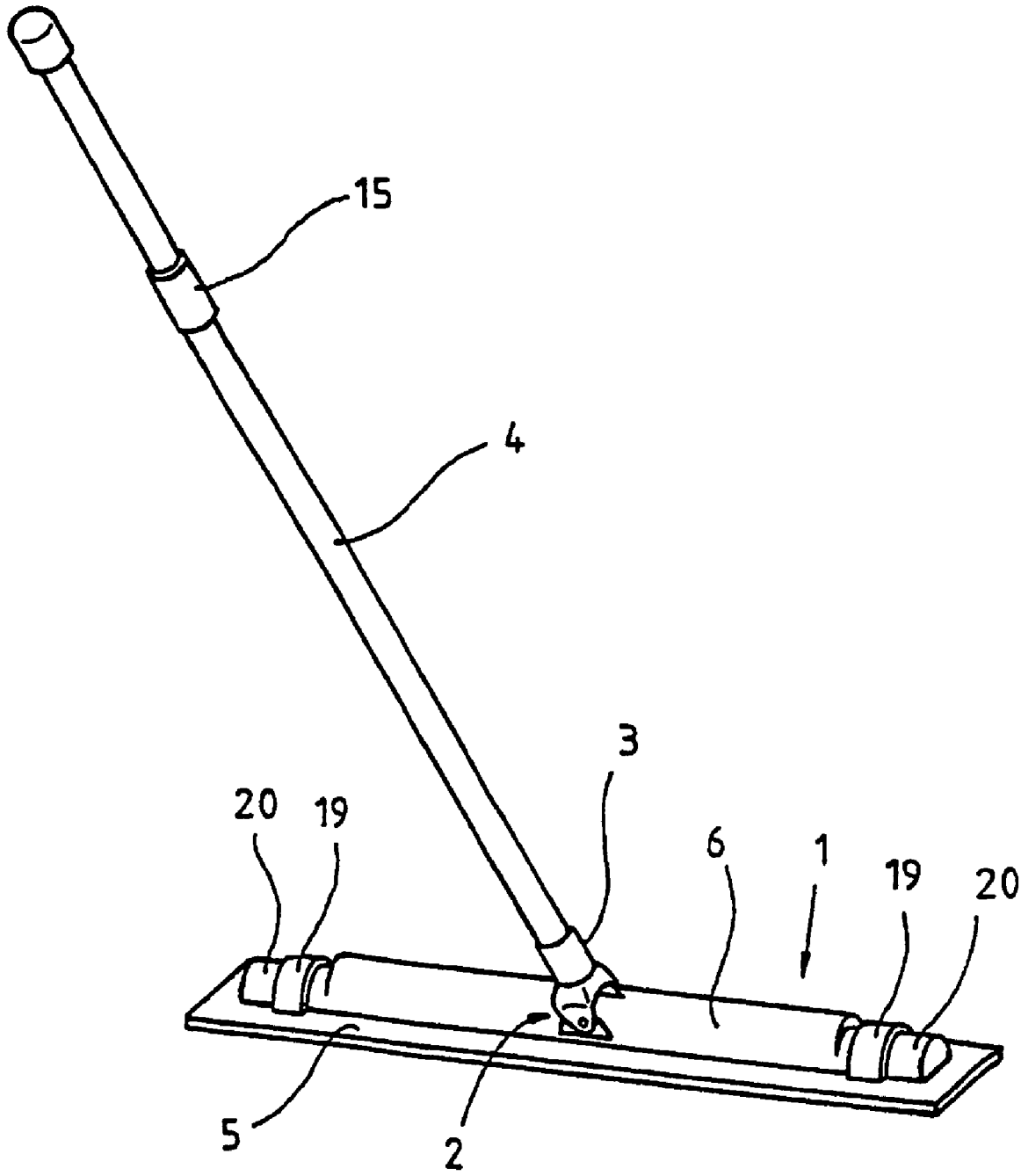
Figure 7:
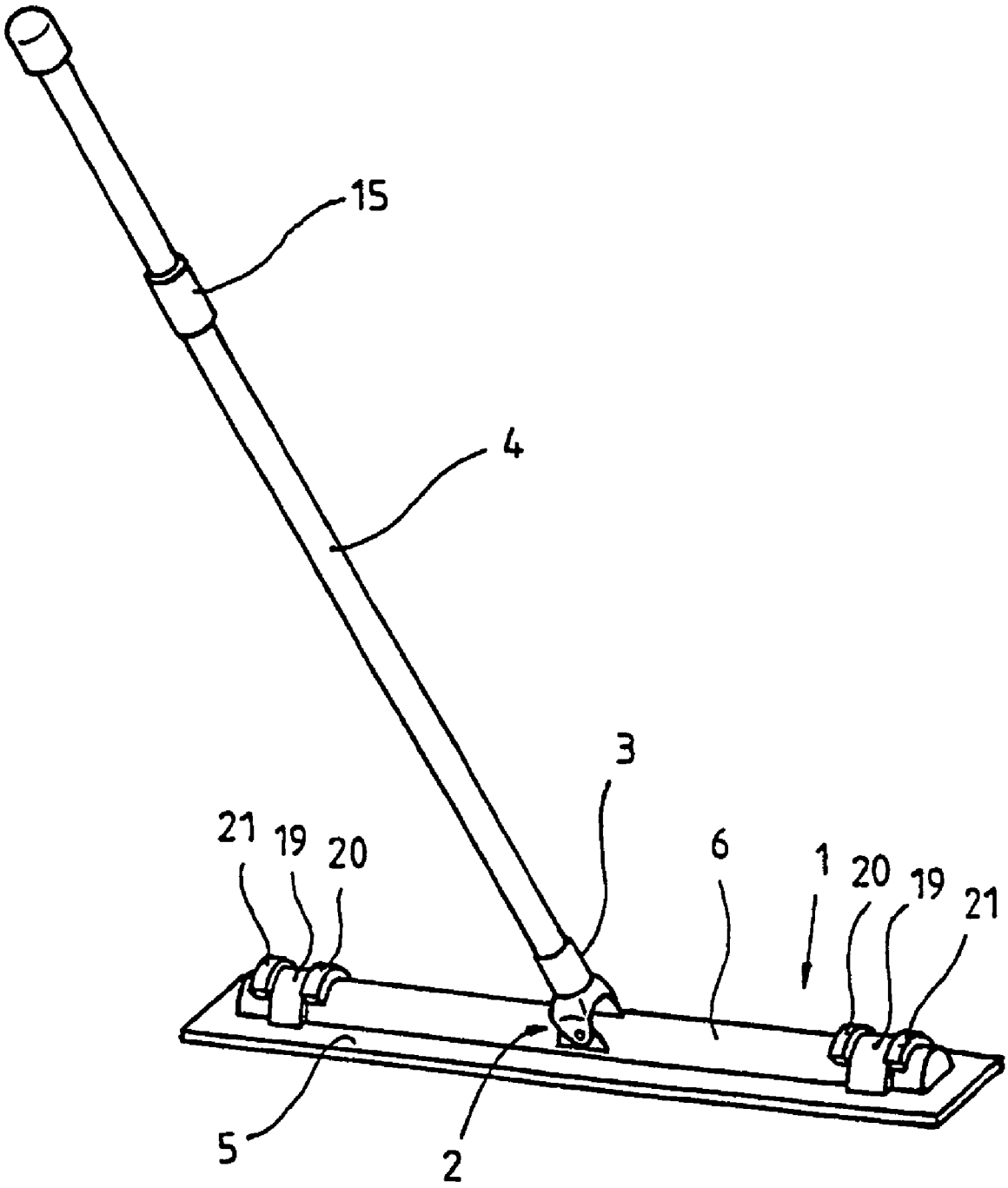

The invention is explained in more detail in the following on the basis of a drawing illustrating merely examples of embodiment. Refinements and developments of general interest of the invention are also explained in conjunction with the explanation of the examples of embodiment on the basis of the drawing. In the drawing:

FIG. 1 shows a preferred example of embodiment of a mopping device according to the invention, FIG. 2*a* shows, in section, the mop covering holder with a closed receiving groove and with the ventilation opening opened, FIG. 2*b* shows, in section, the mop covering holder with an open receiving groove, FIG. 3 shows the mop covering holder from FIG. 2*a*, with the ventilation opening closed, FIG. 4 shows the operating handle of an embodiment of the mopping device in the region of a manual actuating element, FIG. 5 shows a modified embodiment of a mop covering holder of a mopping device according to the invention with a differently arranged ventilation opening, FIG. 6 shows a further, preferred example of embodiment of a mopping device according to the invention and FIG. 7 shows yet a further example of embodiment of a mopping device according to the invention.

The subject of the invention is a mopping device for mopping surfaces to be cleaned, especially floor surfaces, also colloquially termed floor mops. Mopping devices of that kind are also used for other surfaces to be cleaned. A particular field of use of mopping devices of that kind is rooms in facilities to be specially disinfected, for example in hospitals.

The mopping device illustrated in FIG. 1 in overview comprises, firstly, a longitudinally extended mop covering holder 1. This forms a downwardly directed mopping side and a top side which is approximately opposite thereto and here inclined laterally relative thereto. A handle sleeve 3 is mounted at the mop covering holder 1 at the top side and, in particular, preferably by a simple or universal pivot joint 2 relative to the mop covering holder 1. FIG. 1 shows an operating handle 4 inserted into the handle sleeve 3 or integrated with the handle sleeve 3. By means of the operating handle 4 the mop covering holder 1 can be guided, at least with realisation of a universal pivot joint 2, in almost any desired relative position over the surface to be cleaned.

The illustrated example of embodiment shows merely a simple pivot joint 2, thus forming a single pivot axis, not a universal pivot joint.

FIG. 1 further shows a mop covering 5 arranged at the mop covering holder 1 at the mop side and fastened to be replaceable. This covering usually consists of textile or textile-like material, often a synthetic fibre fabric or a synthetic fibre/cotton/mixed fibre with fringes, knoppy yarn or loops, which are arranged on the cleaning surface and at the edge, for optimisation of a cleaning action. Appropriate microfibre products are on occasions nowadays used for this.

The mop covering 5 can be fastened to the mop covering holder 1 in different ways. Additional explanation is given further below with respect to the different fastening techniques.

The problem with known flat mopping devices has been explained in detail in the general part of the description. According to the invention the function of reception and conveying of cleaning liquid is now, in departure from the past, associated with the mop covering holder 1 itself. For that purpose it is provided in accordance with the invention that the mop covering holder 1 has a reservoir 6 for reception of a larger quantity of cleaning liquid, which can issue onto the mop covering 5, which is fastened to the mop covering holder 1, by way of at least one discharge opening 7 in the mop covering holder 1, and that the mop covering holder 1 additionally has at least one ventilation opening 8 by way of which air can escape from the reservoir 6 during filling of the reservoir 6 with cleaning liquid and air can flow back into the reservoir 6 during discharge of cleaning liquid from the reservoir 6. The cross-section of the mop covering holder 1 with the reservoir 6 disposed therein can be recognised particularly clearly in the sections in FIG. 2 and FIG. 3. FIG. 2*a* and FIG. 3 show the ventilation opening 8 once open and once closed. FIG. 5 shows an alternative to the arrangement of the ventilation opening 8.

As long as the ventilation opening 8 or the ventilation openings 8 is or are closed, air is prevented from flowing back into the reservoir 6. Cleaning liquid can thereby be prevented from issuing from the reservoir 6 onto the mop covering 5 to a substantial extent.

The mop covering holder 1 together with the mop covering 5 disposed thereat is lowered, when the ventilation opening 8 is opened, into the storage bucket filled with cleaning liquid, the mop covering 5 in that case is fully soaked with cleaning liquid and cleaning liquid fills the reservoir 6 in the mop covering holder 1, since the air disposed therein can escape through the ventilation opening 8. Subsequently thereto the ventilation opening 8 is closed. The mopping device is placed on the portion of surface to be cleaned. Since the ventilation opening 8 is closed, hardly any cleaning liquid exits from the reservoir 6 in that case. Merely the cleaning liquid stored in the mop covering 5 will then drop down to some degree.

The surface to be cleaned is initially worked with the wet mop covering 5. In the case of decreasing moistening of the surface, the ventilation opening 8 is opened and cleaning liquid can continue flowing onto the mop covering 5. If sufficient cleaning liquid has exited from the reservoir 6, the ventilation opening 8 is closed again and the flow of cleaning liquid onto the mop covering 5 is interrupted. The cleaning liquid is distributed over a further surface portion. This continues until the reserve of cleaning liquid in the reservoir 6 is used up. The cycle can then be repeated anew.

The illustrated embodiment moreover shows a construction which is characterised by the fact that the mop covering holder 1 has an approximately circular cross-section. Obviously, in principle any cross-section of the mop covering holder 1 is suitable. A circular cross-section or approximately circular cross-section is, however, quite convenient in terms of operating technique. Moreover, a mop covering holder 1 defining such a cavity 6 can be produced particularly conveniently.

The illustrated embodiment shows the mop covering holder 1 as a tubular element which is formed in the interior space by virtually just the reservoir 6. The reservoir 6 is closed at the end by closure caps 9 which are, in a given case, be removable. With the closure caps removed, the interior of the mop covering holder 1, thus the reservoir 6, can be rinsed through and thus cleaned.

At the floor side the mop covering holder 1 can, as illustrated, be flattened off in order to ensure a good adaptation to the surface to be cleaned.

A design in which in the illustrated manner the ventilation opening 8 is arranged at the mop covering holder 1 at the top side is advantageous.

In principle it is possible to design the ventilation opening 8 to be closable and openable by hand and, in particular, by means of a movable closure element 10. FIG. 5 shows such a construction with a ventilation opening 8 laterally of the pivot joint 2 of the handle sleeve 3, closed by means of a closure element 10 executed as a withdrawable and re-insertable closure strip. A hook-and-burr strip fastener can, for example, also be provided here. The closure element 10 can, however, also be riveted, glued, clipped or in other manner captively attached to the mop covering holder 1. An entirely removable closure element 10 can also be realised.

There are naturally various alternatives for the design of the closure element 10, for example also construction as a closure plug.

The preferred embodiment illustrated in FIGS. 2 and 3 shows a closure element 10 which is executed as a closure cap here constructed to be resilient and bell-like. Thus, the ventilation opening 8 is closed in rubber-elastic manner and, in fact, in such a manner that even lateral deviations can be tolerated to a substantial degree.

Reference has already been made to the fact that the opening and closing of the ventilation opening 8 is possible by hand. For that purpose, however, a user would have to reach into the storage bucket, which is filled with cleaning liquid, during filling of the mop covering holder 1 and constantly bend over during further operation of the mopping device. That is unpleasant in terms of operating technique and almost unacceptable in the professional field. It is thus necessary to seek a possibility of enabling opening and closing of the ventilation opening 8 by means of a form of remote control.

In the illustrated embodiment it is now provided that the ventilation opening 8 is arranged in the region of the handle sleeve 3 and the closure element 10 is arranged at or in the handle sleeve 3 and adjustable substantially perpendicularly relative to the top side of the mop covering holder 1. FIGS. 2 to 4 in that case further show that in accordance with a preferred design a bearing 11 for the closure element 10 is already provided in the handle sleeve 3. The handle sleeve 3 thus forms the convenient bearing position for the adjustable closure element 10 of the ventilation opening 8. Since the handle sleeve 3 can be part of the operating handle 4, this correspondingly applies also to specific designs of operating handles 4 as such.

The construction explained above is a precondition for the fact that the closure element 10 is adjustable by means of an adjusting mechanism 12, which is arranged at or, preferably, in the operating handle 4 and which is fixable in a closed setting of the closure element 10.

The entire adjusting mechanism 12 also inclusive, ultimately, of the closure element 10 can be externally attached to the operating handle 4 and extend along the operating handle 4 upwardly into the region at which the operating handle 4 is gripped in use. There is thus a comfortable possibility of carrying out the opening and closing of the ventilation opening 8 without having to bend over. Preferably, and thus also provided in the illustrated example of embodiment, the adjusting mechanism 12 is not, however, externally arranged at the operating handle 4, but mounted in the interior of the operating handle 4, which for this purpose is formed to be hollow.

In detail, it is provided in the illustrated and preferred example of embodiment, thus to be recognised in FIG. 2, FIG. 3 and FIG. 4, that the adjusting mechanism 12 has a setting rod 13 which is arranged in or at the operating handle 4 and which is fixable at least in a pushed-forward closed setting holding the closure element 10 in closed position on the ventilation opening 8.

In detail it is here provided that the setting rod 13 for fixing is actuable in a rotary motion about its own axis. It can be recognised particularly well from FIG. 4 how the fixing is realised in the illustrated embodiment. The operating handle 4 is executed as a continuous hollow tube. However, this is adapted in the region of the operation of the adjusting mechanism 12. In particular it is provided that the upper end or an intermediate member of the setting rod 13 extends in an 'L' groove 14 in or at the operating handle 4 and the fixing take place in accordance with the principle of function of a bayonet closure. In detail, it is provided here that the upper end or the intermediate member of the setting rod 13 is provided with a manual actuating element 15 preferably constructed as a sleeve covering the bayonet closure.

When the closure element 10 is withdrawn and the ventilation opening 8 opened the manual actuating element 15 can be pushed downwardly in direction of the mop covering holder 1 and in that case the setting rod 13 can be guided downwardly in the 'L' groove 14 until reaching the angle of the 'L' groove 14. In this setting the closure element 10 has securely closed the ventilation opening 8 (FIG. 3). This takes place in the illustrated embodiment particularly because the bell-like, rubber-elastic construction of the closure element 10 permits a comparatively large travel of the adjusting mechanism 12 from setting down of the closure element 10 up to the end of the adjusting movement. In this position the manual actuating element 15 is rotated about the longitudinal axis of the operating handle 14 whilst entraining the rearward end of the setting rod 13. The end of the setting rod 13 or a corresponding laterally projecting pin migrates in the limb of the 'L' groove 14 extending on the circumference. The adjusting mechanism 12 is thereby fixed in the pushed-forward setting. In the withdrawn setting, the adjusting mechanism 12 fixes itself by the friction of the close-fitting manual actuating element 15 alone.

The illustrated embodiment (FIG. 2*a*, FIG. 3) moreover shows that here the closure element 10 is additionally biased by means of a spring element 12' of the adjusting mechanism 12 into an open setting. The position of FIG. 3 is reached from the position of FIG. 2*a*, thus by pushing down the setting rod 13 against the effect of the spring element 12'. The restoring movement is assisted by the spring element 12'.

Not illustrated in the drawings, however, is that not only a bearing 11 for the closure element 10 is provided at the lower end of the setting rod 13, but yet a further bearing for the setting rod 13 should also be present in an upper region in the operating handle 4.

An alternative, which is not illustrated, consists in allowing the adjusting mechanism 12 to adjust the closure element 10 only linearly. Then provision must be made for being able to fix the closed setting of the closure element 10 by a form of detenting. Techniques of this kind are known from ballpoint pens, to appropriate disclosures of which reference is made.

An alternative for the purely mechanically conceived design of the adjusting mechanism 12 also consists in the adjusting mechanism 12 having a hydraulic transfer path arranged in or at the operating handle 4. In this case a first transfer piston would be in the operating region of the operating handle 4, possibly at the end of the operating handle 4. A second transfer piston would be below at the closure element 10. The space therebetween would be filled with liquid. By pressing down the upper transfer piston the movement thereof would be hydraulically transferred to the lower transfer piston and thus to the closure element 10 and the closure element would be closed. Here a fixing in the closed position and a spring element for restoring the lower transfer piston would also have to be provided.

Since observations with respect to the arrangement and closure of the ventilation opening 8 or the several ventilation openings 8 have now been dealt with, the design and arrangement of the discharge opening 7 or the several discharge opening 7 shall be dealt with in the following. Firstly, it is expedient to arrange the discharge opening 7 or the several discharge openings 7 on the mop side of the mop covering holder 1. Thus, when the mop covering 5 is fastened at the mop covering holder 1 it is ensured that the discharge opening 7 or the several discharge openings 7 is or are covered by the mop covering 5 fastened to the mop covering holder 1.

The discharge opening 7 or the several discharge openings 7 can, at the same time, realise a fastening function for the mop covering 5. It can then be provided that the mop covering 5 is provided with a retaining moulding 16 insertable into the discharge opening 7 or with retaining mouldings 6 insertable into the several discharge openings 7.

The illustrated and, to that extent, preferred embodiment additionally shows a specific fastening technique for the mop covering 5 to the mop covering holder 1. In the state of the art, straps or plug pockets are provided on the rear side of the flat mop covering. In the case of a larger mop covering holder 1, which integrates the tank-like reservoir 6, this can no longer be realised quite so simply. In spite of that, classic fastening techniques are naturally also an alternative. In particular, a variant proposed more recently is of interest, this variant putting into effect narrow, optionally resilient, fastening strips (DE 101 42 084.6 of the applicant, the disclosure content of which is incorporated, by reference, in the present disclosure).

The illustrated and preferred embodiment, however, shows for that purpose that the mop covering holder 1 has at the mop side a receiving groove 17, which extends over its full length, for a strip-like retaining moulding 16 attached to or formed at the mop covering 5. By means of the strip-like retaining moulding 16 the mop covering 5 is inserted or drawn into the receiving groove 17 and thus fixed in its position relative to the mop covering holder 1 (FIG. 1; FIG. 2*b*).

For the formation of the retaining moulding 16 at the mop covering 5 it can be provided that the retaining moulding 16 of the mop covering 6 is a sewn-on strip of textile or textile-like material or a strip formed from the material of the mop covering 5 itself by folding over and stitching down.

The illustrated and preferred embodiment (FIG. 1) moreover shows that the mop covering 5 is executed as a substantially elongated rectangular flat mop covering with a retaining moulding 16 extending approximately centrally. This flat mop covering can be formed particularly easily and simply, because, as explained further above, it has only the cleaning function and the dirt collecting function, but no longer the conveying function for the cleaning liquid.

The illustrated and preferred embodiment shows in section according to FIG. 2*b* a variant with a receiving groove 17 open towards the reservoir 6. The transfer of cleaning liquid from the reservoir 6 to the mop covering 5 is thereby ensured over a large area, although the controllability of the flooding of cleaning liquid suffers in this variant. FIG. 2*a* therefore shows a preferred design in which the receiving groove 17 is closed towards the reservoir 6. This happens by a hollow rail 18 which protrudes into the reservoir 6 and which is part of the mop covering holder 1 or fixedly attached thereto.

It could be provided that [the discharge opening 7 or several discharge openings 7] is or are arranged [in the wall of the] hollow rail 18 forming the receiving groove 17. However, an alternative also consists of providing the discharge opening 7 or the several discharge openings 7 not in the region of the receiving groove 17, but laterally of the receiving groove 17 on the mop side of the mop covering holder 1. This alternative is similarly illustrated in the embodiment according to FIG. 2*a* and FIG. 3.

The arrangement of several small discharge openings 7 laterally of the receiving groove 7 can have the advantage that the mop covering 5 is uniformly and quickly saturated with cleaning liquid in the region laterally of the strip-like retaining moulding 16. On the other hand, the seepage of cleaning liquid directly into the strip-like retaining moulding 16 of the mop covering 5 has, in a given case, the advantage that a certain storage function for cleaning liquid is utilised directly at the mop covering 5.

The illustrated embodiment does not allow recognition of a variant in which the hollow rail 18 is constructed not only as a straight 'U' rail, but at the ends in front of the closure caps 9 is bent over and drawn up relative to the top side of the mop covering holder 1. Thus there would equally be guidance for fastening elements at the mop covering 5.

In the illustrated embodiment the mop covering 5 is provided at the end, preferably at the retaining moulding 16, with fastening elements 19 which are fastenable to fastening counter-elements 20 at the mop covering holder 1. In detail, it is provided here that the fastening counter-elements 20 are arranged at the top side of the mop covering holder 1, wherein here the fastening counter-elements 20 are executed as retaining clips and the fastening elements 19 are executed as strips with retaining knubs or the like at the end.

With a somewhat resilient form of the mop covering 5 and the fastening elements 19 it can be achieved that the mop covering 5 can be clamped in place in optimum manner at the mop covering holder 1 with the retaining moulding 16 engaging in the receiving groove 17 and thus fixed in mechanically positive manner to the mop covering holder 1.

In detail, the following data have proved particularly advantageous for the dimensions of the mopping device. It is provided, at the outset, that the mop covering holder 1 has a length of 300 to 500 mm, preferably approximately 400 mm and, preferably, a diameter of 30 to 50 mm, preferably approximately 40 mm. The mop covering 5 is usually a substantially rectangular flat structure, which can be formed at the mop side to be, for example, suede-like. In detail, it is recommended that the mop covering 5 has a format of about 80 mm×300 mm to about 150 mm×540 mm, preferably approximately 100 mm×460 mm.

Moreover, it is particularly advantageous, thus also illustrated in the drawing, that the mop covering 5 is somewhat longer than the mop covering holder 1, preferably at each of the ends by 20 to 50 mm, particularly approximately 35 mm. The strips, which project beyond the mop covering holder 1, of the mop covering 5 are well-suited to the cleaning of edges, skirting boards and corners in the region of surfaces to be cleaned.

It is has already been explained in detail above that and why the teaching of the invention leads to the result that it is possible to work with a substantially less expensive and lighter mop covering 5. In detail, it is provided in accordance with the preferred teaching that the mop covering 5 consists of textile or textile-like material with only a small liquid storage effect and has a weight of approximately 40 g to 70 g, preferably approximately 50 g, for an area of approximately 100 mm×460 mm.

An optimum design of the mop covering holder 1 and the mop covering 5 unites a mop covering holder of a length of approximately 400 mm with a mop covering in a format of approximately 100 mm×460 mm for a weight of about 50 g of the mop covering 5.

Mention has already been made above of the fact that the subject of disclosure of the present application is the use of a variant with narrow, optionally resilient, fastening strips (DE 101 42 084.6 of the applicant). These variants are taken up again in detail in the further claims 39 to 50, for which purpose reference is to be made to these claims.

FIG. 6 shows in the case the example of embodiment there that here the diameter of the reservoir 6 is reduced at the ends to a smaller size. For example, the diameter of 40 mm in the centre region of the reservoir 6 is reduced at the end to 30 mm. The reduction is here realised in stepped manner, but in principle a chamfering is also conceivable.

In the case of the illustrated, step-like reduction the mop covering holder 1 is initially placed on the mob covering 5 to be laterally offset. Through a counter movement, the narrowed end of the reservoir 6 moves under the fastening strip, which forms the fastening element 19 at the mop covering 5, whereby a transposition to the centre region of the reservoir 6 takes place. The fastening strip is thereby stretched. As soon as the opposite end of the reservoir 6 stands in front of the other fastening element 19 of the mop covering 5, the reservoir 6 is moved in opposite direction so that the reduced end region of smaller diameter enters there. The two fastening elements 19, which are constructed as resilient fastening strips, now embrace the reduced end regions of the reservoir 6 and the mop covering 5 is fastened to the reservoir 6 of the mop covering holder to be secure against slipping.

In the case of the example of embodiment according to FIG. 7, projections at the upper side are provided on the one hand as counter elements 20 and on the other hand as individual projections 21 spaced therefrom. Here the respective resilient fastening element 19 can snap into place between elements 20, 21 in order to fix the mop covering 5 to the reservoir 6 to the mop covering holder 1.

The subject of the invention is also a mop covering holder 1 for a mopping device, as such, according to the invention with features which are relevant for the mop covering holder 1 and have been previously described.

The subject of the invention is also a mop covering 5 for a mopping device, as such, according to the invention with the features which have been previously illustrated as of particular interest for the mop covering 5.

The invention claimed is:

1. A mopping device for mopping surfaces comprising:

a. a longitudinally extending mop covering holder having a mopping side and a top side;

b. a handle sleeve mounted on the mop covering holder at the top side;

c. an operating handle integrated with the handle sleeve;

d. a mop covering arranged at the mop covering holder at the mopping side and;

e. at least one ventilation opening located on the mop covering holder through which air can escape, wherein the ventilation opening is manually closable and openable by means of a movable closure element and the closure element is adjustable by means of an adjusting mechanism which is located at the operating handle and which is fixable in a closed setting holding the closure element in a closed position on the ventilation opening.

2. The mopping device of claim 1, wherein the handle sleeve further comprises a pivot joint.

3. The mopping device of claim 2, wherein the pivot joint is selected from the group consisting of a simple joint and a universal joint.

4. The mopping device of claim 1, wherein the operating handle is inserted in the handle sleeve.

5. The mopping device of claim 1, wherein the mop covering is replaceable.

6. The mopping device of claim 1, wherein the mop covering is a textile.

7. The mopping device of claim 1, the mop covering holder further comprising a reservoir and at least one discharge opening located in the mop covering holder wherein cleaning liquid can flow from the reservoir through the discharge opening and onto the mop covering.

8. The mopping device of claim 7, wherein the discharge opening is arranged on the mopping side of the mop covering holder.

9. The mopping device of claim 7, wherein the discharge opening is covered by the mop covering.

10. The mopping device of claim 7, wherein the mop covering further comprises retention molding insertable into the discharge opening.

11. The mopping device of claim 1, wherein the mop covering holder has an approximately circular cross-section.

12. The mopping device of claim 1, wherein the ventilation opening is located on the top side of the mop covering holder.

13. The mopping device of claim 1, wherein the closure element is selected from the group consisting of a closure plug, a withdrawable and re-insertable closure strip, and a closure cap.

14. The mopping device of claim 1, wherein the ventilation opening is arranged in the region of the handle sleeve, and the closure element is arranged on the handle sleeve.

15. The mopping device of claim 14, further comprising a bearing for the closure element, the bearing located in the handle sleeve.

16. The mopping device of claim 1, wherein the adjusting mechanism is a setting rod.

17. The mopping device of claim 16, wherein the setting rod is actuable, for fixing, in a rotary motion about the axis thereof.

18. The mopping device of claim 16, wherein the setting rod is an L shape and fixing is effected in accordance with the functional principle of a bayonet closure.

19. The mopping device of claim 1, wherein the mop covering comprises a substantially elongated rectangular flat mop covering.

20. The mopping device of claim 1, wherein the mop covering is slightly longer than the mop covering holder.

* * * * *